US006144248A

United States Patent [19]

Oosugi et al.

[11] Patent Number: 6,144,248

[45] Date of Patent: Nov. 7, 2000

[54] REFERENCE VOLTAGE GENERATING CIRCUIT HAVING A TEMPERATURE CHARACTERISTIC CORRECTION CIRCUIT PROVIDING LOW TEMPERATURE SENSITIVITY TO A REFERENCE VOLTAGE

[75] Inventors: Toshio Oosugi, Chiba; Akihiko Fujiwara, Tokyo, both of Japan

[73] Assignee: Ricoh Company, Ltd., Tokyo, Japan

[21] Appl. No.: 09/354,920

[22] Filed: Jul. 13, 1999

[30] Foreign Application Priority Data

Jul. 16, 1998 [JP] Japan ..... 10-202187

[51] Int. Cl.[7] ..... H01H 37/76

[52] U.S. Cl. ..... 327/525; 327/530

[58] Field of Search ..... 327/525, 530, 327/538, 513, 512, 537

[56] References Cited

U.S. PATENT DOCUMENTS 4,417,263 11/1983 Matsuura ..... 357/23

FOREIGN PATENT DOCUMENTS 1217611 8/1989 Japan .
6230836 8/1994 Japan .

*Primary Examiner*—Jung Ho Kim
*Attorney, Agent, or Firm*—Cooper & Dunham LLP

[57] ABSTRACT

A reference voltage generating circuit generates a reference voltage having a flat temperature characteristic over a practical temperature range. In a reference voltage transistor pair, a depletion N-channel field effect transistor and an enhancement N-channel field effect transistor are connected in series between a first voltage source and a second voltage source so that the reference voltage is output from a juncture between a gate of the depletion N-channel field effect transistor and a gate of the enhancement N-channel field effect transistor. A temperature characteristic correction circuit is provided to at least one of the depletion N-channel field effect transistor and the enhancement N-channel field effect transistor. The temperature characteristic correction circuit changes temperature sensitivity of the reference voltage by changing an effective gate size of the one of the depletion N-channel field effect transistor and the enhancement N-channel field effect transistor.

11 Claims, 6 Drawing Sheets

REFERENCE VOLTAGE GENERATING CIRCUIT HAVING A TEMPERATURE CHARACTERISTIC CORRECTION CIRCUIT PROVIDING LOW TEMPERATURE SENSITIVITY TO A REFERENCE VOLTAGE

BACKGROUND OF THE INVENTION

1. Field of the Invention

The present invention generally relates to a reference voltage generating circuit and, more particularly, to a reference voltage generating circuit used for an electronic circuit provided in a portable electronic device such as a personal digital assistant (PDA) device, portable telephone including a personal digital cellular phone (ODC) and a personal handyphone system (PHS) or a portable audio device such as a mini disk (MD) player.

The reference voltage generating circuit is also used in a circuit for detecting an excessive charge or discharge current which circuit is provided in an integrated circuit (IC) for protecting a lithium ion battery from being excessively charged or discharged.

2. Description of the Related Art

Japanese laid-Open Patent Application No.1-217611 discloses a reference voltage generating circuit formed in a semiconductor device. FIG. 1 shows the reference voltage generating circuit disclosed in this patent document. In the reference voltage generating circuit shown in FIG. 1, a plurality of MOS transistors 3A to 14A are connected in series, and the MOS transistor 3A is connected to a direct current power source 1A via a resistor 2A having a high resistance. The reference voltage generating circuit further comprising a plurality of switching elements 15A to 19A connected to the MOS transistors 3A to 7A, respectively so that a constant voltage is obtained by a voltage drop generated across the MOS transistors 15A to 19A.

Additionally, Japanese Laid-Open Patent Application No.6-230836 discloses a reference voltage generating circuit formed in a semiconductor device. FIG. 2 shows the reference voltage generating circuit disclosed in this patent document. The reference voltage generating circuit shown in FIG. 2 comprises a current source 1B connected to a voltage source Vcc, a second transistor 2B, a third transistor 3B, a first resistive element 4B and a second resistive element 5B. A collector and a base of the first transistor 2B are connected to the current source 1B. A collector of the second transistor 3B is connected to an emitter of the first transistor 2B. The first resistive element 4B is connected between the base of the first transistor 2B and a base of the second transistor 3B. The second resistive element 5B is connected between the base of the second transistor 3B and an emitter of the second transistor 3B. In this arrangement, a reference voltage V0 is output from a juncture between an emitter of the first transistor 2B and a collector of the second transistor 3B. The reference voltage V0 is adjusted to cancel a fluctuation due to a change in temperature by appropriately setting a resistance of each of the first and second resistive elements 4B and 5B.

However, in the above mentioned conventional reference voltage generating circuits, there is a problem in that a temperature characteristic of the reference voltage is not uniform due to dispersion in an amount of ion implantation to form a gate of each of the transistors. Such a problem is particularly considerable when the reference voltage generating circuit is used with a low-voltage source since a threshold voltage of each of the transistors must be small which results in high sensitivity to temperature.

Additionally, the dispersion in the production process of the transistors may reduce an yield rate of the reference voltage generating circuit.

SUMMARY OF THE INVENTION

It is a general object of the present invention to provide an improved and useful reference voltage generating circuit in which the above-mentioned problems are eliminated.

A more specific object of the present invention is to provide a reference voltage generating circuit which generates a reference voltage having a flat temperature characteristic over a practical temperature range.

In order to achieve the above-mentioned objects, there is provided according to the present invention a reference voltage generating circuit for generating a reference voltage by using a first voltage supplied by a first voltage source and a second voltage supplied by a second voltage source, the reference voltage generating circuit comprising:

a reference voltage transistor pair comprising a depletion N-channel field effect transistor and an enhancement N-channel field effect transistor connected in series between the first voltage source and the second voltage source so that the reference voltage is output from a juncture between a gate of the depletion N-channel field effect transistor and a gate of the enhancement N-channel field effect transistor; and a temperature characteristic correction circuit provided to at least one of the depletion N-channel field effect transistor and the enhancement N-channel field effect transistor, wherein the temperature characteristic correction circuit changes temperature sensitivity of the reference voltage by changing an effective gate size of the one of the depletion N-channel field effect transistor and the enhancement N-channel field effect transistor.

According to the above-mentioned invention, the temperature characteristic correction circuit changes an effective gate size of at least one of the depletion N-channel field effect transistor and the enhancement N-channel field effect transistor. A threshold voltage of each of the depletion N-channel field effect transistor and the enhancement N-channel field effect transistor can be changed by changing the effective gate size thereof. A temperature characteristic of the threshold voltage is changed by changing the threshold voltage. Since the temperature sensitivity of the reference voltage is dependent on the threshold voltages of the depletion N-channel field effect transistor and the threshold voltage of the enhancement N-channel field effect transistor, the temperature sensitivity (temperature characteristic) of the reference voltage can be decreased by appropriately changing the effective gate size of at least one of the depletion N-channel field effect transistor and the enhancement N-channel field effect transistor.

In one embodiment according to the present invention, the temperature characteristic correction circuit is provided to each of the depletion N-channel field effect transistor and the enhancement N-channel field effect transistor.

Since the temperature characteristic of the reference voltage can be represented by a liner function of the threshold voltage of the depletion N-channel field effect transistor and the threshold voltage of the enhancement N-channel field effect transistor, the temperature characteristic of the reference voltage can be precisely adjusted by independently adjusting the gate size of each of the depletion N-channel field effect transistor and the enhancement N-channel field effect transistor.

The temperature characteristic correction circuit according to the present invention may include:

at least one field effect transistor of the same type with the one of the depletion N-channel field effect transistor and the enhancement N-channel field effect transistor to which the temperature characteristic correction circuit is provided, a gate of the at least one field effect transistor being connected to the gate of the depletion N-channel field effect transistor; and a fuse element short-circuiting between a drain of the at least one field effect transistor and a source of the at least one field effect transistor so that the at least one field effect transistor is effected by cutting the at least one fuse element.

Accordingly, if the depletion field effect transistor provided in the temperature characteristic correcting circuit should be connected to the depletion N-channel field effect transistor of the reference voltage transistor pair so as to Increase an effective gate size of the depletion N-channel field effect transistor of the reference voltage transistor pair, this can be achieved by merely cutting the fuse element which initially short circuits the depletion field effect transistor provided in the temperature characteristic correcting circuit.

In one embodiment according to the present invention, a plurality of field effect transistors and a plurality of fuse elements are provided in the temperature characteristic correction circuit so that a fine adjustment of the effective gate size can be achieved by selectively cutting the fuse elements so as to connect a desired number of field transistors to the reference voltage transistor pair.

Other objects, features and advantages of the present invention will become more apparent from the following detailed description when read in conjunction with the accompanying drawings.

DETAILED DESCRIPTION OF THE PREFERRED EMBODIMENT

Figure 1:
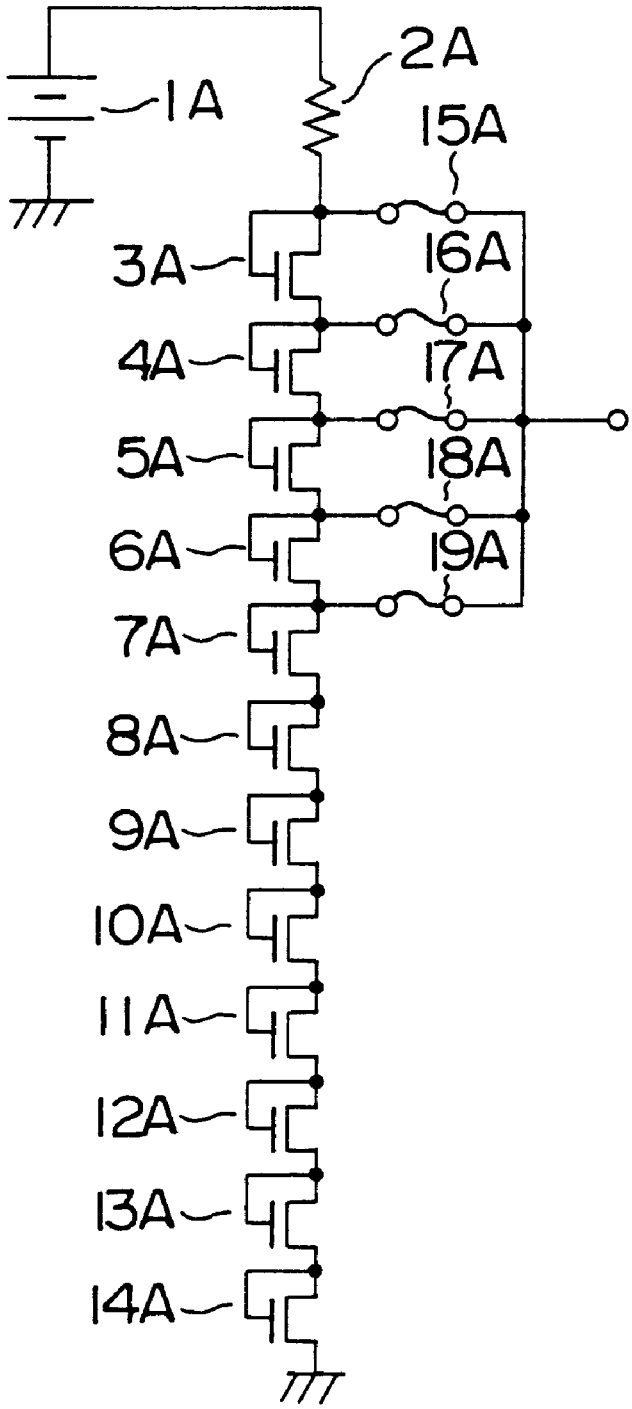
FIG. 1 PRIOR ART
FIG. 1 is a circuit diagram of a conventional reference voltage generating circuit.
Figure 2:
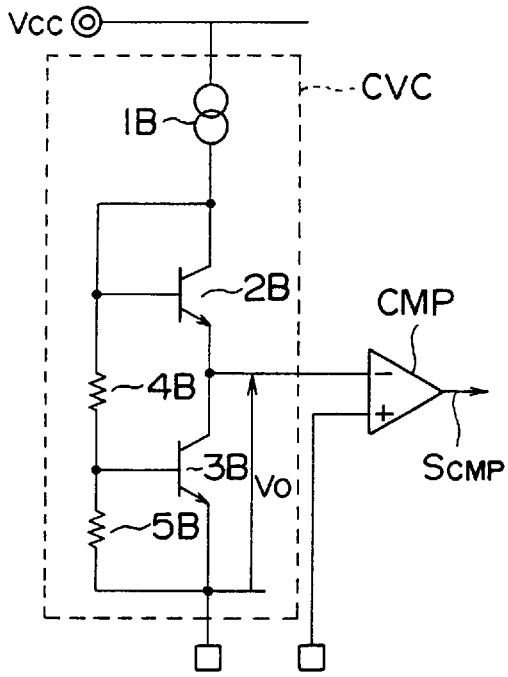
FIG. 2 PRIOR ART
FIG. 2 is a circuit diagram of another conventional reference voltage generating circuit.
Figure 4:
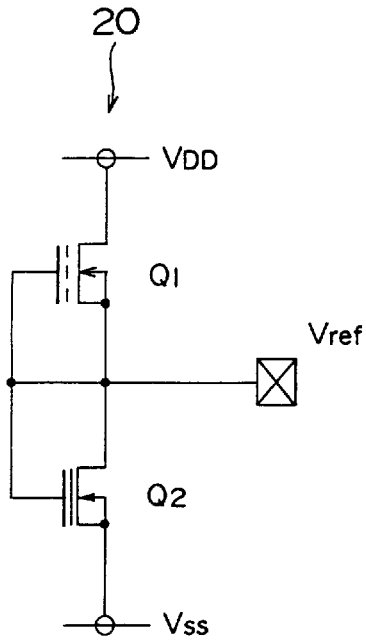
FIG. 4 is a circuit diagram of an equivalent circuit of the reference voltage generating circuit shown in FIG. 3.
Figure 3:
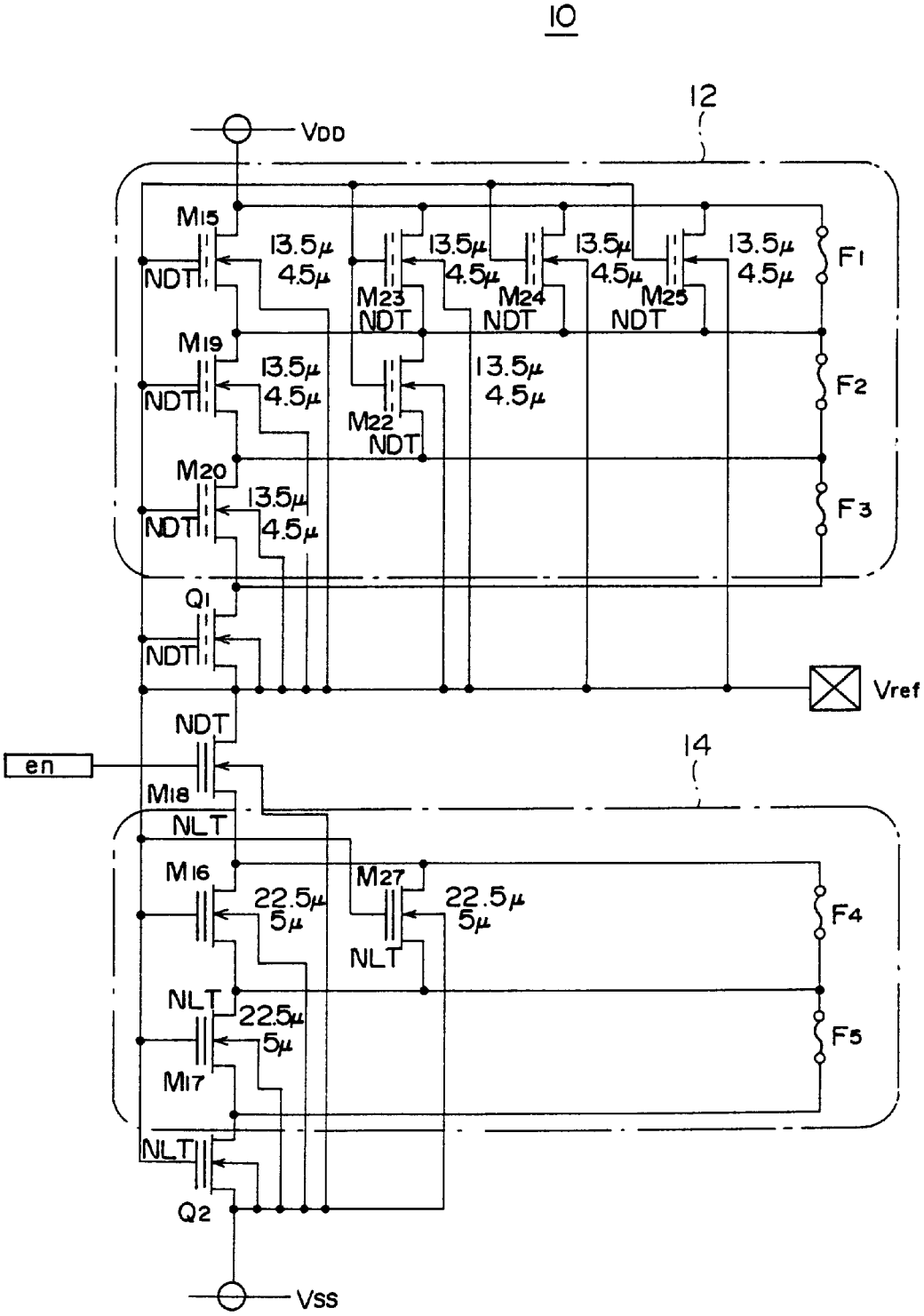
FIG. 3 is a circuit diagram of a reference voltage generating circuit according to a first embodiment of the present invention.

A description will now be given of a first embodiment of the present invention. FIG. 3 is a circuit diagram of a reference voltage generating circuit according to the first embodiment of the present invention. FIG. 4 is a circuit diagram of an equivalent circuit of the reference voltage generating circuit shown in FIG. 3.

A description will now be given of a principle of the reference voltage generating circuit 10 shown in FIG. 3 by referring to the equivalent circuit 20 shown in FIG. 4. The reference voltage generating circuit 10 shown in FIG. 3 can be represented by the equivalent circuit 20 shown in FIG. 4. In FIG. 4, a depletion N-channel field effect transistor Q1 and an enhancement N-channel field effect transistor Q2 are connected in series between a supply line of a first supply voltage $V_{DD}$ and a supply line of a second supply voltage $V_{SS}$. More specifically, a drain of the depletion N-channel field effect transistor Q1 is connected to the supply line of the first supply voltage $V_{DD}$. A source of the enhancement N-channel field effect transistor Q2 is connected to the supply line of the second supply voltage $V_{SS}$. A gate of the depletion N-channel field effect transistor Q1 and a gate of the enhancement N-channel field effect transistor Q2 are connected to a reference voltage terminal so that a reference voltage $V_{ref}$ is output from the reference voltage terminal.

The reference voltage generating circuit 10 shown in FIG. 3 is provided with an upper-stage temperature characteristic correction circuit 12 and a lower-stage temperature characteristic correction 14 so as to correct a temperature characteristic of the reference voltage $V_{ref}$ output from the reference voltage terminal. The upper-stage temperature characteristic correction circuit 12 is provided between the supply line of the first supply voltage $V_{DD}$ and the reference voltage terminal of the reference voltage $V_{ref}$. The lower-stage temperature characteristic correction circuit 14 is provided between the supply line of the second supply voltage $V_{SS}$ and the reference voltage terminal of the reference voltage $V_{ref}$.

The reference voltage generating circuit 10 is provided with an enhancement N-channel field effect transistor M18. A drain of the enhancement N-channel field effect transistor M18 is connected to a source of the depletion N-channel field effect transistor Q1. A source of the enhancement N-channel field effect transistor M18 is connected to the reference voltage terminal of the reference voltage $V_{ref}$. The enhancement N-channel field effect transistor M18 serves as a switching element which disconnects the enhancement N-channel field effect transistor Q2 from the deletion N-channel field effect transistor Q1 when an operational mode of the device in which the reference voltage generating circuit 10 is provided is set in a standby mode.

The upper-stage temperature characteristic correction circuit 12 comprises a plurality of depletion N-type field effect transistors M15, M19, M20, M22, M23, M24 and M25 and a plurality of fuses F1, F2 and F3. Each of the depletion N-channel field effect transistors M15, M19, M20, M22, M23, M24 and M25 has the same gate configuration W/L= 13.5$\mu$/4.5$\mu$, where W is a width of the gate and L is a length of the gate. The depletion N-channel field effect transistors are grouped into three groups. The first group includes the depletion N-channel transistor M20. The second group includes the depletion N-channel field effect transistors M19 and M22. The third group includes the depletion N-channel field effect transistors M15, M23, M24 and M25. Accordingly, in this embodiment, the first group includes one ($2^0$=1) transistor; the second group includes two ($2^1$=2) transistors; and the third group includes four ($2^2$=4) transistors.

A source of the depletion N-channel field effect transistor M20 is connected to the drain of the depletion N-channel field effect transistor Q1. A gate of the depletion N-channel field effect transistor M20 is connected to a gate of the depletion N-channel field effect transistor Q1. The fuse F3 is connected between a drain and the source of the depletion N-channel field effect transistor M20 so as to short-circuit between the drain and the source of the depletion N-channel field effect transistor M20 of the first group. Accordingly, the depletion N-channel field effect transistor M20 is effective only when the fuse F3 is cut by means of laser trimming.

The depletion N-channel field effect transistors M19 and M22 of the second group are connected in parallel. That is, drains of the depletion N-channel field effect transistors M19 and M22 are connected to each other, and sources of the depletion N-channel field effect transistors M19 and M22 are connected to each other. The sources of the depletion N-channel field effect transistors M19 and M22 are connected to the drain of the depletion N-channel field effect transistor M20. A gate of each of the depletion N-channel field effect transistors M19 and M22 is connected to the gate of the depletion N-channel field effect transistor Q1. Additionally, the fuse F2 is connected between the sources and the drains of the depletion N-channel field effect transistors M19 and M22 so as to short-circuit between the drain and the source of each of the depletion N-channel field effect transistors M19 and M22 of the second group. Accordingly, the depletion N-channel field effect transistors M19 and M22 are effective only when the fuse F2 is cut by means of laser trimming.

The depletion N-channel field effect transistors M15, M23, M24 and M25 of the third group are connected in parallel. That is, drains of the depletion N-channel field effect transistors M15, M23, M24 and M25 are connected to each other, and sources of the depletion N-channel field effect transistors M15, M23, M24 and M25 are connected to each other. The sources of the depletion N-channel field effect transistors M15, M23, M24 and M25 are connected to the drains of the depletion N-channel field effect transistors M19 and M22. Drains of the depletion N-channel field effect transistors M15, M23, M24 and M25 are connected to the supply line of the first supply voltage $V_{DD}$. A gate of each of the depletion N-channel field effect transistors M15, M23, M24 and M25 is connected to the gate of the depletion N-channel field effect transistor Q1. Additionally, the fuse F1 is connected between the sources and the drains of the depletion N-channel field effect transistors M15, M23, M24 and M25 so as to short-circuit between the drain and the source of each of the depletion N-channel field effect transistors M15, M23, M24 and M25 of the third group. Accordingly, the depletion N-channel field effect transistors M15, M23, M24 and M25 are effective only when the fuse F1 is cut by means of laser trimming.

It should be noted that a back gate or substrate of each of the depletion N-channel field effect transistors M15, M19, M20, M22, M23, M24 and M25 is connected to the reference voltage terminal of the reference voltage $V_{ref}$.

According to the above-mentioned arrangement of the upper-stage temperature characteristic correction circuit 12, an effective gate size (a gate width W or a gate length L) can be changed by selectively cutting the fuses F1, F2 and F3. Thus, a temperature characteristic of the threshold voltage $V_{tnd}$ of the depletion N-channel field effect transistor Q1 can be changed by selectively cutting the fuses F1, F2 and F3 so as to effect some or all of the depletion N-channel field effect transistors M15, M19, M20, M22, M23, M24 and M25. The fuses F1, F2 and F3 can be cut by means of laser trimming. The laser trimming process is performed after the reference voltage generating circuit 10 is completely formed and measurement is taken for the temperature characteristic of the threshold voltage $V_{tnd}$ of the depletion N-channel field effect transistor Q1.

A description will now be given of the lower-stage temperature characteristic correction circuit 14. The lower-stage temperature characteristic correction circuit 14 comprises a plurality of enhancement N-type field effect transistors M16, M17 and M27 and a plurality of fuses F4 and F5. Each of the enhancement N-channel field effect transistors M16, M17 and M27 has the same gate configuration W/L=22.5$\mu$/5$\mu$, where W is a width of the gate and L is a length of the gate. The enhancement N-channel field effect transistors are grouped into two groups. The first group includes the enhancement N-channel transistor M17. The second group includes the enhancement N-channel field effect transistors M16 and M27. Accordingly, in this embodiment, the first group includes one ($2^0$=1) transistor, and the second group includes two ($2^1$=2) transistors.

A source of the enhancement N-channel field effect transistor M17 is connected to the drain of the enhancement N-channel field effect transistor Q2. A gate of the enhancement N-channel field effect transistor M17 is connected to a gate of the enhancement N-channel field effect transistor Q2. The fuse F5 is connected between a drain and the source of the enhancement N-channel field effect transistor M17 so as to short-circuit between the drain and the source of the enhancement N-channel field effect transistor M17 of the first group. Accordingly, the enhancement N-channel field effect transistor M17 is effective only when the fuse F5 is cut by means of laser trimming.

The enhancement N-channel field effect transistors M16 and M27 of the second group are connected in parallel. That is, drains of the enhancement N-channel field effect transistors M16 and M27 are connected to each other, and sources of the enhancement N-channel field effect transistors M16 and M27 are connected to each other. The sources of the enhancement N-channel field effect transistors M16 and M27 are connected to the drain of the enhancement N-channel field effect transistor M17. A gate of each of the enhancement N-channel field effect transistors M16 and M27 is connected to the gate of the enhancement N-channel field effect transistor Q2. The drains of the enhancement N-channel field effect transistors M16 and M27 are connected to the source of the depletion N-channel field effect transistor M18. Additionally, the fuse F4 is connected between the sources and the drains of the enhancement N-channel field effect transistors M16 and M27 so as to short-circuit between the drain and the source of each of the enhancement N-channel field effect transistors M16 and M27 of the second group. Accordingly, the enhancement N-channel field effect transistors M16 and M27 are effective only when the fuse F4 is cut by means of laser trimming.

It should be noted that a back gate or substrate of each of the enhancement N-channel field effect transistors M16, M17 and M27 is connected to the supply line of the second supply voltage $V_{SS}$.

According to the above-mentioned arrangement of the upper-stage temperature characteristic correction circuit 14, an effective gate size (a gate width W or a gate length L) can be changed by selectively cutting the fuses F4 and F5. Thus, a temperature characteristic of the threshold voltage $V_{tne}$ of the enhancement N-channel field effect transistor Q2 can be changed by selectively cutting the fuses F4 and F5 so as to effect some or all of the enhancement N-channel field effect transistors M16, M17 and M27. The fuses F4 and F5 can be cut by means of laser trimming. The laser trimming process is performed after the reference voltage generating circuit 10 is completely formed and measurement is taken for the temperature characteristic of the threshold voltage $V_{tne}$ of the enhancement N-channel field effect transistor Q2.

A description will now be given of a method for correcting a temperature characteristic of the reference voltage $V_{ref}$ output from the reference voltage generating circuit 10.

The voltage reference generating circuit 10 shown in FIG. 3 uses the depletion N-channel field effect transistor Q1 and the enhancement N-channel field effect transistor Q2 so as to generate the reference voltage $V_{ref}$. The gate size (W/L) of each of the depletion N-channel field effect transistor Q1 and the enhancement N-channel field effect transistor Q2 is determined so that the temperature characteristic of the reference voltage $V_{ref}$ is flat when each of the depletion N-channel field effect transistor Q1 and the enhancement N-channel field effect transistor Q2 is formed within a predetermined design target range.

However, if a threshold voltage $V_{th}$ of the depletion N-channel field effect transistor Q1 or the enhancement N-channel field effect transistor Q2 is out of the predetermined design target range, the temperature characteristic of the reference voltage $V_{ref}$ can not be maintained to be flat. That is, the reference voltage $V_{ref}$ becomes more temperature sensitive. In order to eliminate such a problem, in the reference voltage generating circuit 10 according to the present embodiment is provided with the upper-stage temperature characteristic correction circuit 12 and the lower-stage temperature characteristic correction circuit 14. That is, the upper-stage temperature characteristic correction circuit 12 is capable of changing an effective gate size (W/L) of the depletion N-channel field effect transistor Q1, and the lower-stage temperature characteristic correction circuit 14 is capable of changing an effective gate size (W/L) of the enhancement N-channel field effect transistor Q2.

Specifically, in the upper-stage temperature characteristic correction circuit 12, some of the depletion N-channel field effect transistors M15, M19, M20, M22, M23, M24 and M25 are selectively effected by cutting respective fuses F1, F2 and F3 so that the selected transistors are connected to the depletion N-channel field effect transistor Q1 so as to change an effective gate size of the depletion N-channel field effect transistor Q1. That is, a temperature characteristic of the threshold voltage $V_{tnd}$ of the depletion N-channel field effect transistor Q1 is changed by connecting the some of the depletion N-channel field effect transistors M15, M19, M20, M22, M23, M24 and M25.

More specifically, in order to effect the depletion N-channel field effect transistor M20, the fuse F3 is cut. In order to effect the depletion N-channel field effect transistors M19 and M22, the fuse F2 is cut. In order to effect the depletion N-channel field effect transistors M15, M23, M24 and M25, the fuse F1 is cut.

As mentioned above, each of the depletion N-channel field effect transistors M15, M19, M20, M22, M23, M24 and M25 has the same gate size (W/L=13.5$\mu$/4.5$\mu$). Accordingly, when the fuse F3 is cut, the gate size (W/L) of the depletion N-channel field effect transistor Q1 is increased by the gate size W/L=13.5$\mu$/4.5$\mu$ of the depletion N-channel field effect transistor M20. Additionally, when fuse F2 is cut, the gate size (W/L) of the depletion N-channel field effect transistor Q1 is increased by a half of the gate size W/L=13.5$\mu$/4.5$\mu$ of each of the depletion N-channel field effect transistors M19 and M22 since the depletion N-channel field effect transistors M19 and M22 are connected in parallel. Further, when fuse F1 is cut, the gate size (W/L) of the depletion N-channel field effect transistor Q1 is increased by a quarter of the gate size W/L=13.5$\mu$/4.5$\mu$ of each of the depletion N-channel field effect transistors M15, M23, M24 and M25 since the depletion N-channel field effect transistors M15, M23, M24 and M25 are connected in parallel.

Figure 5:
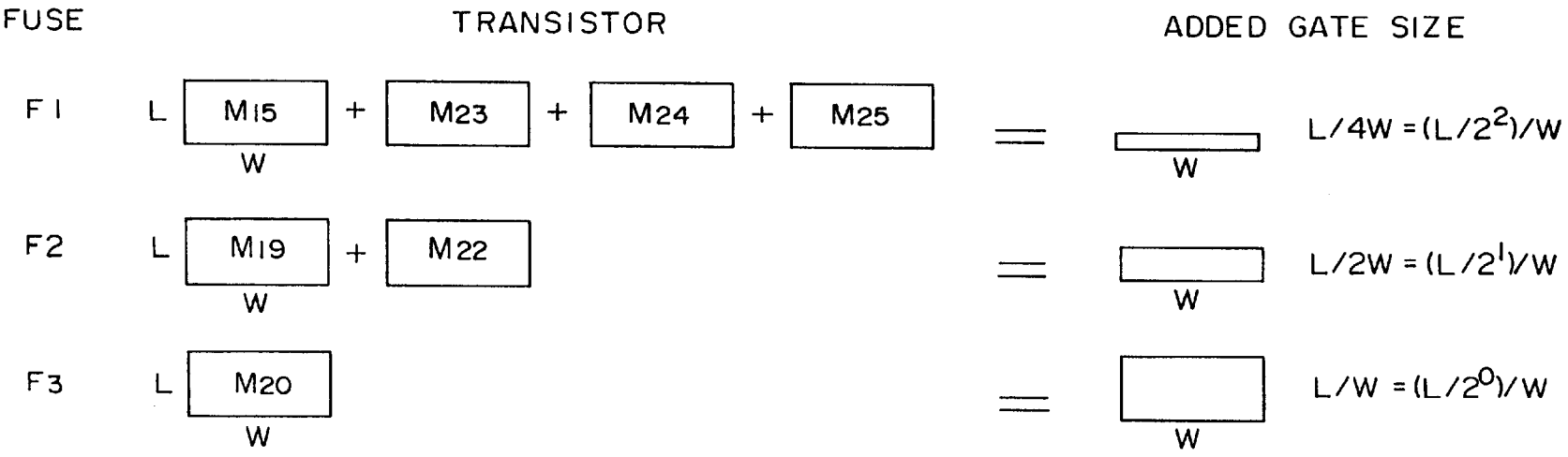
FIG. 5 is an illustration for explaining an effective gate size added by a temperature characteristic correction circuit.

FIG. 5 illustrates a relationship between the fuses to be cut, the effective transistors and the gate size added to the gate size of the depletion N-channel field effect transistor Q1. In FIG. 5, for the sake of simplification, only a length L of the gate is varied and a width W of the gate is not changed. If only the fuse F1 is cut, the gate size L/4W is added. If only the fuse F2 is cut, the gate size L/2W is added. If only the fuse F3 is cut, the gate size W/L is added. If the fuse F1 and the fuse F2 are cut, the gate size 3L/4W is added. Accordingly, by selecting the fuses F1, F2 and F3 to be cut, the added gate size can be one of L/4W, L/2W (2L/4W), 3L/4W, L/W (4L/4W), 5W/4L, 3L/2W (6L/4W) and 7L/4W. Thus, a precise adjustment can be done by selecting the fuses F1, F2 and F3 to be cut.

Similar to the upper-stage temperature characteristic correction circuit 12, the lower-stage temperature characteristic correction circuit 14 is capable of changing an effective gate size of the enhancement N-channel field effect transistor Q2. That is, the effective gate size of the enhancement N-channel field effect transistor Q2 can be changed by selectively cutting the fuses F4 and F5. When the fuse F4 is cut the enhancement N-channel field effect transistors M16 and M27 are connected to the enhancement N-channel field effect transistor Q2. When the fuse F5 is cut, the enhancement N-channel field effect transistor M17 is connected to the enhancement N-channel field effect transistor Q2. Accordingly, a temperature characteristic of the threshold voltage $V_{tne}$ of the enhancement N-channel field effect transistor Q2 can be changed by selectively cutting the fuses F4 and F5.

The reference voltage $V_{ref}$ is represented by the threshold voltage $V_{tnd}$ of the depletion N-channel field effect transistor Q1 and the threshold voltage $V_{tne}$ of the enhancement N-channel field effect transistor Q2, where KD1 is a conductivity coefficient of the depletion N-channel field effect transistor Q1 and KE1 is a conductivity coefficient of the enhancement N-channel field effect transistor Q2.

$$V_{ref}=V_{tne}-(KD1/KE1)^{1/2}\times V_{tnd} \quad (1)$$

Figure 6:
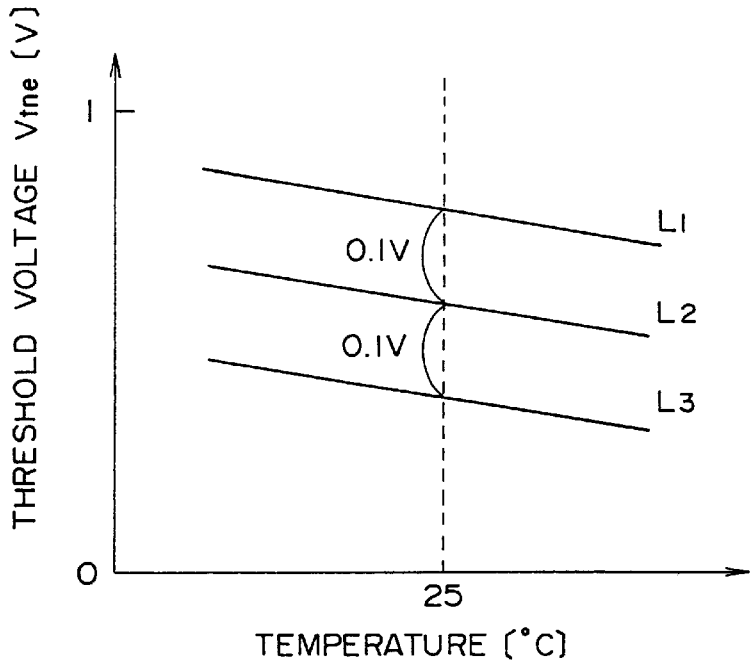
FIG. 6 is a graph showing a temperature characteristic of a threshold voltage of an enhancement N-channel field effect transistor.

FIG. 6 is a graph showing a change in the threshold voltage $V_{tne}$ of the enhancement N-channel field effect transistor Q2 when a temperature is changed. In the graph shown in FIG. 6, a line L2 indicates the threshold voltage $V_{tne}$ when the threshold voltage $V_{tne}$ is a target design voltage at a temperature 25° C. A line L1 indicates the threshold voltage $V_{tne}$ when the threshold voltage $V_{tne}$ is deviated by +0.1 V from the target design voltage at the temperature 25° C. A line L3 indicates the threshold voltage $V_{tne}$ when the threshold voltage $V_{tne}$ is deviated by −0.1 V from the target design voltage at the temperature 25° C.

As appreciated from the graph of FIG. 6, slopes of the line L1 and line L3 are almost equal to a slope of the line L2. This means that the slope of the threshold voltage $V_{tne}$ of the enhancement N-channel field effect transistor Q2 is maintained substantially the same even if the threshold voltage $V_{tne}$ deviates from the target design voltage.

Figure 7:
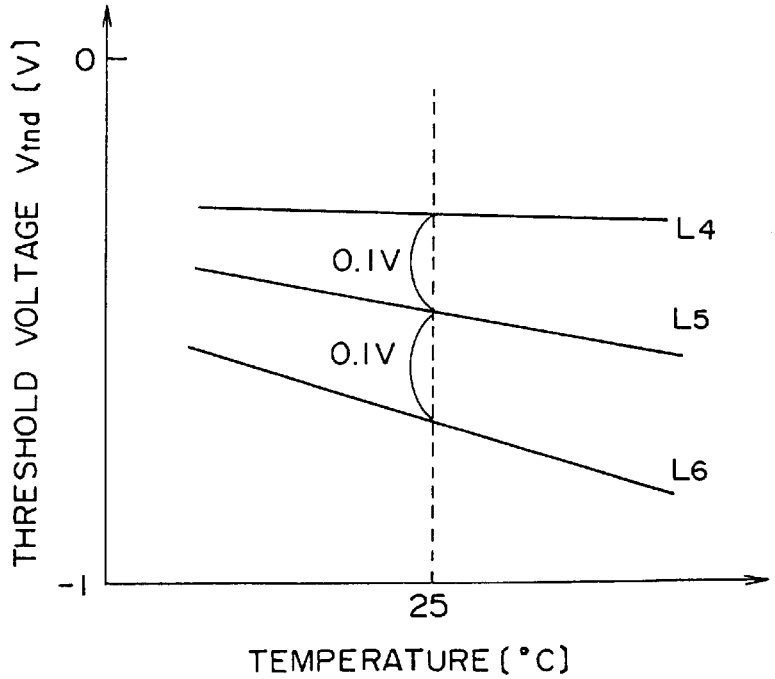
FIG. 7 is a graph showing a temperature characteristic of a threshold voltage of a depletion N-channel field effect transistor.

FIG. 7 is a graph showing a change in the threshold voltage $V_{tnd}$ of the depletion N-channel field effect transistor Q1 when a temperature is changed. In the graph shown in FIG. 7, a line L5 indicates the threshold voltage $V_{tnd}$ when the threshold voltage $V_{tnd}$ is a target design voltage at a temperature 25° C. A line L4 indicates the threshold voltage $V_{tnd}$ when the threshold voltage $V_{tnd}$ is deviated by +0.1 V from the target design voltage at the temperature 25° C. A line L6 indicates the threshold voltage $V_{tnd}$ when the threshold voltage $V_{tnd}$ is deviated by −0.1 V from the target design voltage at the temperature 25° C.

As appreciated from the graph of FIG. 7, a slope of the line L4 is smaller than a slope of the line L5, and a slope of line L6 is larger than the slope of the line L5. This means that an amount of change in the threshold voltage $V_{tnd}$ fluctuates when the threshold voltage $V_{tnd}$ deviates from the target design voltage. It should be noted that the depletion N-channel field effect transistor Q1 and the enhancement N-channel field effect transistor Q2 are designed so that the slope of the line L5 of the depletion N-channel field effect transistor Q1 shown in FIG. 7 is substantially equal to the slope of the line L2 of the enhancement N-channel field effect transistor Q2 shown in FIG. 6.

Additionally, the following equation (2) is derived from the equation (1), where $\Delta V_{ref}$ is an amount of change in the reference voltage $V_{ref}$ with respect to a change in temperature; $\Delta V_{tne}$ is an amount of change in the threshold voltage $V_{tne}$ with respect a change in temperature; and $\Delta V_{tnd}$ is an amount of change in the threshold voltage $V_{tnd}$ with respect to a change in temperature.

$$\Delta V_{ref}=\Delta V_{tne}-(\Delta KD1/\Delta KE1)^{1/2}\Delta V_{tnd} \quad (2)$$

Referring to the equation (2), if it is assumed that changes in the conductivity coefficients KD1 and KE1 with respect to temperature is negligibly small, the temperature characteristic of the reference voltage $V_{ref}$ is mainly dependent on the change ($\Delta V_{tne}$) in the threshold voltage $V_{tne}$ and the change ($\Delta V_{tnd}$) in the threshold voltage $V_{tnd}$.

As appreciated from the graphs of FIGS. 6 and 7, the following relationships are established between an absolute value of the threshold value $V_{tnd}$ of the depletion N-channel field effect transistor Q1 and an absolute value of the threshold voltage $V_{tne}$ of the enhancement N-channel field effect transistor Q2.

$|\Delta V_{tnd}|>|\Delta V_{tne}|$; if $|V_{tnd}|$ is greater than the target design voltage of the threshold voltage $V_{tnd}$.

$|\Delta V_{tnd}|<|\Delta V_{tne}|$; if $|V_{tnd}|$ is smaller than the target design voltage of the threshold voltage $V_{tnd}$.

Figure 8:
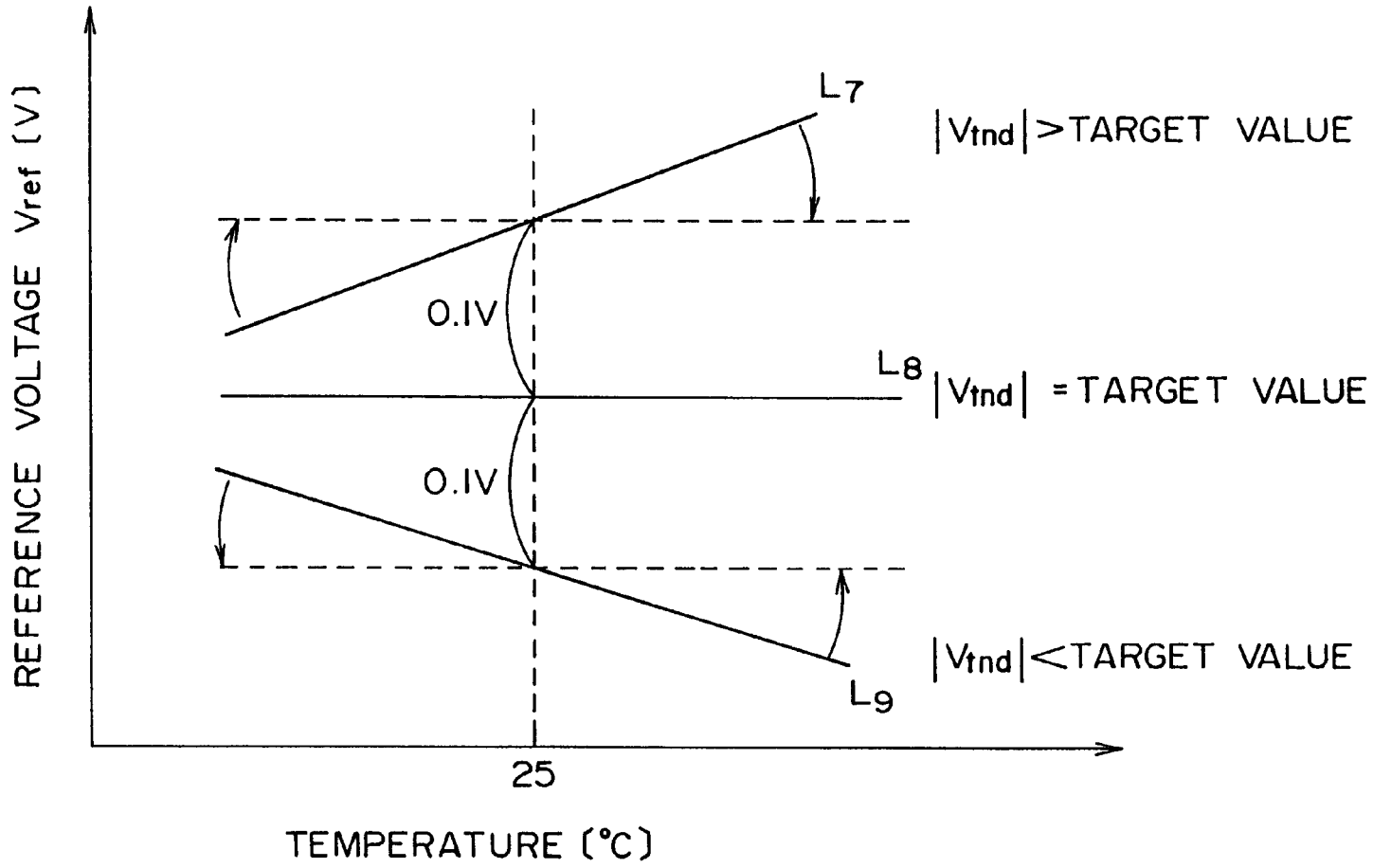
FIG. 8 is a graph showing a temperature characteristic of a reference voltage.

The gate size (W/L) of each of the depletion N-channel field effect transistor Q1 and the enhancement N-channel field effect transistor Q2 is determined so that the first term and the second term of the right side of the equation (2) is equal to each other. Accordingly, when an absolute value of the threshold voltage $V_{tnd}$ is equal to or close to the target design value, the temperature characteristic of the reference voltage $V_{ref}$ is substantially flat as indicated by a line L8 in a graph of FIG. 8. Thus, there is no need to adjust the gate size of each of the depletion N-channel field effect transistor Q1 and the enhancement N-channel field effect transistor Q2.

On the other hand, if the absolute value of the threshold voltage $V_{tnd}$ is greater than the target design value (this corresponds to the line L6 of FIG. 7), the second term is greater than the first term in the right side of the equation (2). Accordingly, the reference voltage $V_{ref}$ has a positive temperature characteristic with respect to temperature as indicated by a line L7 of FIG. 8 (L7=L2−L6). That is, the reference voltage $V_{ref}$ increases as the temperature increases. Thus, in order to cancel the slope of the line L7, that is, in order to obtain a flat temperature characteristic as indicated by a dashed line, the effective gate length (L) of the depletion N-channel field effect transistor Q1 is increased so that the first term and the second term are equal to each other in the equation (2).

On the other hand, if the absolute value of the threshold voltage $V_{tnd}$ is smaller than the target design value (this corresponds to the line L4 of FIG. 7), the first term is greater than the second term in the right side of the equation (2). Accordingly, the reference voltage $V_{ref}$ has a negative temperature characteristic with respect to temperature as indicated by a line L9 of FIG. 8 (L9=L2−L4). That is, the reference voltage $V_{ref}$ decreases as the temperature increases. Thus, in order to cancel the slope of the line L9, that is, in order to obtain a flat temperature characteristic as indicated by a dashed line, the effective gate length (L) of the enhancement N-channel field effect transistor Q2 is increased so that the first term and the second term are equal to each other in the equation (2).

As mentioned above, the temperature characteristic of the reference voltage $V_{ref}$ output from the reference voltage generating circuit 10 can be maintained to be substantially flat, if the temperature characteristic of the depletion N-channel field effect transistor Q1 and the enhancement N-channel field effect transistor Q2 is deviated due to deviation in the manufacturing process, by adjusting the effective gate size of one or both of the depletion N-channel field effect transistor Q1 and the enhancement N-channel field effect transistor Q2 so as to equalize the first term and the second term of the right side of the equation (2).

In this embodiment, the transistors included in the upper-stage temperature characteristic correction circuit 12 and the lower-stage temperature characteristic correction circuit 14 are cut by means of laser trimming after the reference voltage generating circuit 10 is formed on a semiconductor wafer and the threshold voltage $V_{tnd}$ is actually measured. If the measurement of the threshold voltage $V_{tnd}$ is taken by sampling within a wafer and if the threshold voltage $V_{tnd}$ deviates within the wafer, a precise correction for each individual reference voltage generating circuit cannot be achieved. Accordingly, in order to achieve a precise correction for each individual reference voltage generating circuit, the measurement must be taken for each individual reference voltage generating circuit.

It should be noted that the gate size (W/L) of each of the depletion N-channel field effect transistors M15, M19, M20, M22, M23, M24, M25 and Q1 and each of the enhancement N-channel field effect transistors M16, M17, M27 and Q2 can be determined by experiments. In this embodiment, the gate size of each of the depletion N-channel field effect transistors M15, M19, M20, M22, M23, M24 and M25 is 13.5μ/4.5μ. The gate size of each of the enhancement N-channel field effect transistors M16, M17 and M27 is 22.5μ/5μ.

The present invention is not limited to the specifically disclosed embodiments, and variations and modifications may be made without departing from the scope of the present invention.

The present application is based on Japanese priority application No.10-202187 filed on Jul. 16, 1998, the entire contents of which are hereby incorporated by reference.

What is claimed is:

1. A reference voltage generating circuit for generating a reference voltage by using a first voltage supplied by a first voltage source and a second voltage supplied by a second voltage source, said reference voltage generating circuit comprising:

a reference voltage transistor pair comprising a depletion N-channel field effect transistor and an enhancement N-channel field effect transistor connected in series between said first voltage source and said second voltage source so that the reference voltage is output from a juncture between a gate of said depletion N-channel field effect transistor and a gate of said enhancement N-channel field effect transistor; and a temperature characteristic correction circuit provided to at least one of said depletion N-channel field effect transistor and said enhancement N-channel field effect transistor, wherein said temperature characteristic correction circuit changes temperature sensitivity of the reference voltage by changing an effective gate size of said one of said depletion N-channel field effect transistor and said enhancement N-channel field effect transistor.

2. The reference voltage generating circuit as claimed in claim 1, wherein said temperature characteristic correction circuit is provided to each of said depletion N-channel field effect transistor and said enhancement N-channel field effect transistor.

3. The reference voltage generating circuit as claimed in claim 1, wherein said temperature characteristic correction circuit includes:

at least one field effect transistor of the same type with said one of said depletion N-channel field effect transistor and said enhancement N-channel field effect transistor to which said temperature characteristic correction circuit is provided, a gate of said at least one field effect transistor being connected to the gate of said depletion N-channel field effect transistor; and a fuse element short-circuiting between a drain of said at least one field effect transistor and a source of said at least one field effect transistor so that said at least one field effect transistor is effected by cutting said at least one fuse element.

4. The reference voltage generating circuit as claimed in claim 1, wherein said temperature characteristic correction circuit includes an upper-stage temperature characteristic correction circuit connected between said first voltage source and said depletion N-type field effect transistor; and said upper-stage temperature characteristic correction circuit includes at least one first depletion N-channel field effect transistor having a gate connected to the gate of said depletion N-channel field effect transistor and at least one first fuse element short-circuiting between a drain and source of said at least one first depletion N-channel field effect transistor so that said at least one first depletion N-type field effect transistor is effected by cutting said at least one first fuse element.

5. The reference voltage generating circuit as claimed in claim 4, wherein said reference voltage transistor pair and said temperature characteristic correction circuit are formed in a semiconductor circuit device, and said at least one first fuse element is adapted to be cut by means of laser trimming.

6. The reference voltage generating circuit as claimed in claim 4, wherein said upper-stage temperature characteristic correction circuit includes:

a plurality of first depletion N-channel field transistors each of which has a gate connected to the gate of said depletion N-channel field effect transistor, said first depletion N-channel field transistors grouped into n groups, where n is an integer, so that said first depletion N-channel field effect transistors grouped into different groups are connected in series and said first depletion N-channel field effect transistors grouped into the same group are connected parallel; and a plurality of first fuse elements each of which short-circuits between a gate and a drain of each of said first depletion N-type field effect transistors included in a respective one of the n groups so that each of said first depletion N-channel field effect transistors included in a respective one of the n groups is effected by cutting a respective one of said first fuse elements.

7. The reference voltage generating circuit as claimed in claim 6, wherein said first depletion N-channel field effect transistors have the same gate size, and a number of said first depletion N-channel field effect transistors included in the nth group is $2^{n-1}$.

8. The reference voltage generating circuit as claimed in claim 1, wherein said temperature characteristic correction circuit includes a lower-stage temperature characteristic correction circuit connected between said depletion N-channel field effect transistor and said enhancement N-channel field effect transistor; and said lower-stage temperature characteristic correction circuit includes at least one first enhancement N-channel field effect transistor having a gate connected to the gate of said enhancement N-channel field effect transistor and at least one second fuse element short-circuiting between a drain and a source of said at least one first enhancement N-channel field effect transistor so that said at least one first enhancement N-channel field effect transistor is effected by cutting said at least one second fuse element.

9. The reference voltage generating circuit as claimed in claim 8, wherein said reference voltage transistor pair and said temperature characteristic correction circuit are formed in a semiconductor circuit device, and said at least one second fuse element is adapted to be cut by means of laser trimming.

10. The reference voltage generating circuit as claimed in claim 8, wherein said lower-stage temperature characteristic correction circuit includes:

a plurality of first enhancement N-channel field transistors each of which has a gate connected to the gate of said enhancement N-channel field effect transistor, said first enhancement N-channel field effect transistors grouped into n groups, where n is an integer, so that said first enhancement N-channel field effect transistors grouped into different groups are connected in series and said first enhancement N-channel field effect transistors grouped into the same group are connected parallel; and a plurality of second fuse elements each of which short-circuits between a gate and a drain of each of said first enhancement N-channel field effect transistors included in a respective one of the n groups so that each of said first enhancement N-channel field effect transistors included in a respective one of the n groups is effected by cutting a respective one of said second fuse elements.

11. The reference voltage generating circuit as claimed in claim 10, wherein said first enhancement N-channel field effect transistors have the same gate size, and a number of said first enhancement N-channel field effect transistors included in the nth group is $2^{n-1}$.

* * * * *